US008246434B2

(12) United States Patent
Moody

(10) Patent No.: US 8,246,434 B2
(45) **Date of Patent: *Aug. 21, 2012**

(54) TOURNAMENT VIDEO POKER

(75) Inventor: Ernest W Moody, Las Vegas, NV (US)

(73) Assignee: Ernest Moody Revocable Trust, Las Vegas, NV (US)

( * ) Notice: Subject to any disclaimer, the term of this patent is extended or adjusted under 35 U.S.C. 154(b) by 642 days.

This patent is subject to a terminal disclaimer.

(21) Appl. No.: 12/352,703

(22) Filed: Jan. 13, 2009

(65) Prior Publication Data

US 2009/0170583 A1 Jul. 2, 2009

Related U.S. Application Data

(63) Continuation-in-part of application No. 12/240,910, filed on Sep. 29, 2008.

(51) Int. Cl.
*A63F 9/24* (2006.01)

(52) U.S. Cl. ..... 463/9

(58) Field of Classification Search ..... 463/10–14, 463/20, 22; 273/292, 274
See application file for complete search history.

(56) References Cited

U.S. PATENT DOCUMENTS

| | | | | |
|---|---|---|---|---|
| 5,785,593 | A * | 7/1998 | Wood et al. | 463/13 |
| 5,823,873 | A | 10/1998 | Moody | |
| 5,879,233 | A | 3/1999 | Stupero | |
| 6,077,163 | A | 6/2000 | Walker et al. | |
| 6,174,237 | B1 | 1/2001 | Stephenson | |
| 6,319,127 | B1 | 11/2001 | Walker et al. | |
| 6,517,074 | B1 | 2/2003 | Moody et al. | |
| 7,104,542 | B2 | 9/2006 | Peterson | |
| 7,422,521 | B2 | 9/2008 | Peterson | |
| 7,494,410 | B2 | 2/2009 | Romik | |
| 2004/0248642 | A1 | 12/2004 | Rothschild | |
| 2005/0127606 | A1 * | 6/2005 | Snow et al. | 273/292 |
| 2006/0082063 | A1 * | 4/2006 | Moody et al. | 273/292 |
| 2008/0179830 | A1 * | 7/2008 | Webb et al. | 273/274 |

* cited by examiner

*Primary Examiner* — Brook Kebede
(74) *Attorney, Agent, or Firm* — John Edward Roethel

(57) ABSTRACT

Each player who is participating in the video poker tournament plays a designated group of video poker hands. The designated group of video poker hands comprises preselected starting hands so that each tournament participant plays the same starting hands. After the group of video poker hands has been completed, the player with the highest score or highest amount of accrued credits is awarded a prize. Besides awarding a prize to the player with the highest score, other lesser prizes could be awarded to other players who have high scores. Prizes could also be awarded to players who achieve a final score of at least a certain level.

17 Claims, 4 Drawing Sheets

TOURNAMENT VIDEO POKER

CROSS-REFERENCE TO RELATED APPLICATION

This application is a Continuation-in-Part of application Ser. No. 12/240910, filed Sep. 29, 2008, which application is based on and claims the benefit of U.S. Provisional Application Ser. No. 60/975963, filed Sep. 28, 2007, the disclosure of which is incorporated herein in its entirety.

This disclosure relates to electronic video poker games, and more particularly to electronic video poker games in which a player competes in a tournament format by playing video poker.

BACKGROUND OF THE INVENTION

Traditionally, electronic casino games, such as video poker, slot machines, video keno and the like, have been played on stand alone gaming machine. Each player is seated in front of his own gaming machine and the electronic computer controls necessary to operate and play the gaming machine are contained in each gaming machine.

With the advent of player tracking systems, gaming machines now contain the electronics necessary for the machine's computer controls to communicate with a remote server which can be located on the property of the gaming establishment or can even be located off the gaming establishment's property at a remote location.

Currently, the evolution of electronic gaming machines is toward what is known as "server-based gaming" (SBG) in which all of the operation control of each gaming machine is provided on a server located at a remote location from the gaming machine itself, either on-site or off-site the property of the gaming location.

For example, SBG is explained in U.S. Published Patent Application 20040248642 (Rothschild), the disclosure of which is hereby incorporated by reference.

An advantage of the SBG environment on electronic gaming machines is the possibility of providing communication between two or more electronic gaming machines. The present disclosure allows two or more players, each sitting at his own gaming machine, to participate in a video poker tournament. The video poker tournament can require that each player make a wager or payment to enter the tournament or the video poker tournament may be provided by the gaming establishment without requiring each player to pay to participate.

There are many types of video poker games that can be played on an electronic gaming machine. Traditional video poker is a single player game in which a player plays one poker hand against a pay table, and not against other players' hands or a dealer's hand. The player attempts to achieve final card combinations that are based on poker hand rankings. Typically an initial hand is dealt to the player and the player is allowed to discard unwanted cards and replacement cards are provided for the discarded cards to form a final poker hand. The final poker hand is compared to a pay table to determine winning and losing hands and the player receives a payout based on the amount of his wager for a winning hand.

Multiple hand video poker allows the player to play multiple hands of video poker at the same time. Typically, the player is dealt two or more starting hands with each starting hand having the same cards. The player is allowed to discard unwanted cards and replacement cards are provided for the discarded cards to form the final poker hands. The player may discard the same cards from each starting hand or the player may discard different cards from each starting hand. Each of the final poker hands are compared to a pay table to determine winning and losing hands and the player receives a payout based on the amount of his wager for each winning hand. Typical multiple hand poker games come in three, five, ten, twenty, twenty-five, fifty and one hundred hand poker formats. Multiple hand poker is described in U.S. Pat. Nos. 5,823,873 and 6,517,074, the disclosure of each is hereby incorporated by reference.

Flat rate play video poker changes the manner in which rounds of video poker are purchased, with each round of video poker typically comprising the player of one hand of cards. As discussed above, in traditional video poker, a player makes a wager for each round that is played. In flat rate player video poker, a player purchases a fixed number of rounds of video poker. The player then knows how many rounds of video poker the player can play for the amount of money he has invested. Flat rate play video poker is described in U.S. Pat. Nos. 6,077,163 and 6,319,127, the disclosure of each is hereby incorporated by reference.

There is a need for allowing any of these forms of video poker to be played in a tournament format in which multiple players can compete against one another. This would add excitement to the play of video poker and provide for larger payouts than can be provided in typical single player versions of video poker.

Slot machine and video poker machine tournaments have been conducted in casinos for some time. The typical tournament is to have each tournament player play a similar slot machine or video poker machine for a designated length of time. The player or players with the highest scores at the end of the tournament receive awards in the form of cash or prizes.

A drawback to the typical video poker tournament format is that each player may receive different starting hands during his time of playing the video poker machine. The players who receive better starting hands will have a better chance of winning the tournament.

There is a need to provide a tournament format in which each player has the same opportunity to receive awards and this can be achieved by providing each player in the tournament with the same starting hands.

SUMMARY OF THE INVENTION

Each player who is participating in the video poker tournament plays a designated group of video poker hands. The designated group of video poker hands comprises preselected starting hands so that each tournament participant plays the same starting hands. After the group of video poker hands has been completed, the player with the highest score or highest amount of accrued credits is awarded a prize.

Besides awarding a prize to the player with the highest score, other lesser prizes could be awarded to other players who have high scores. Prizes could also be awarded to players who achieve a final score of at least a certain level.

Each participant could purchase an entry into the tournament or the gaming establishment could award free or partially paid entries into the tournament.

DETAILED DESCRIPTION OF THE PREFERRED EMBODIMENTS

The method of the present disclosure involves having multiple players participate in a video poker tournament. Each player can use a video poker machine that is configured to interact with the main computer in a SBG environment. This allows the operation of each video poker machine to be controlled and monitored by the main computer. Alternatively, conventional video poker machines that are linked together in any suitable manner may be used.

Any of the various types of video poker formats may be used in any of the various versions for tournament game play. Each of the designated number of initial starting hands may be single hand poker, multiple hand poker or flat rate play video poker. Or the game types may be mixed together with some of the hands being single hand poker, some of the hands may be multiple hand poker and some of the hands may be flat rate play poker.

If preselected starting hands are used, certain interesting starting hands may be included to add excitement to the game play. For example, the last hand of play could be a starting hand showing four cards to a Royal Flush or three Aces so that a player has the chance to receive a large payout on the last hand should the player achieve a Royal Flush or Four Aces.

Likewise, if the final hand were in a multiple hand format such as ten play poker, the player could have the opportunity to achieve a large payout on the final hand should the player be dealt a good starting hand ten times as would happen in ten play poker.

Version 1

Figure 1:
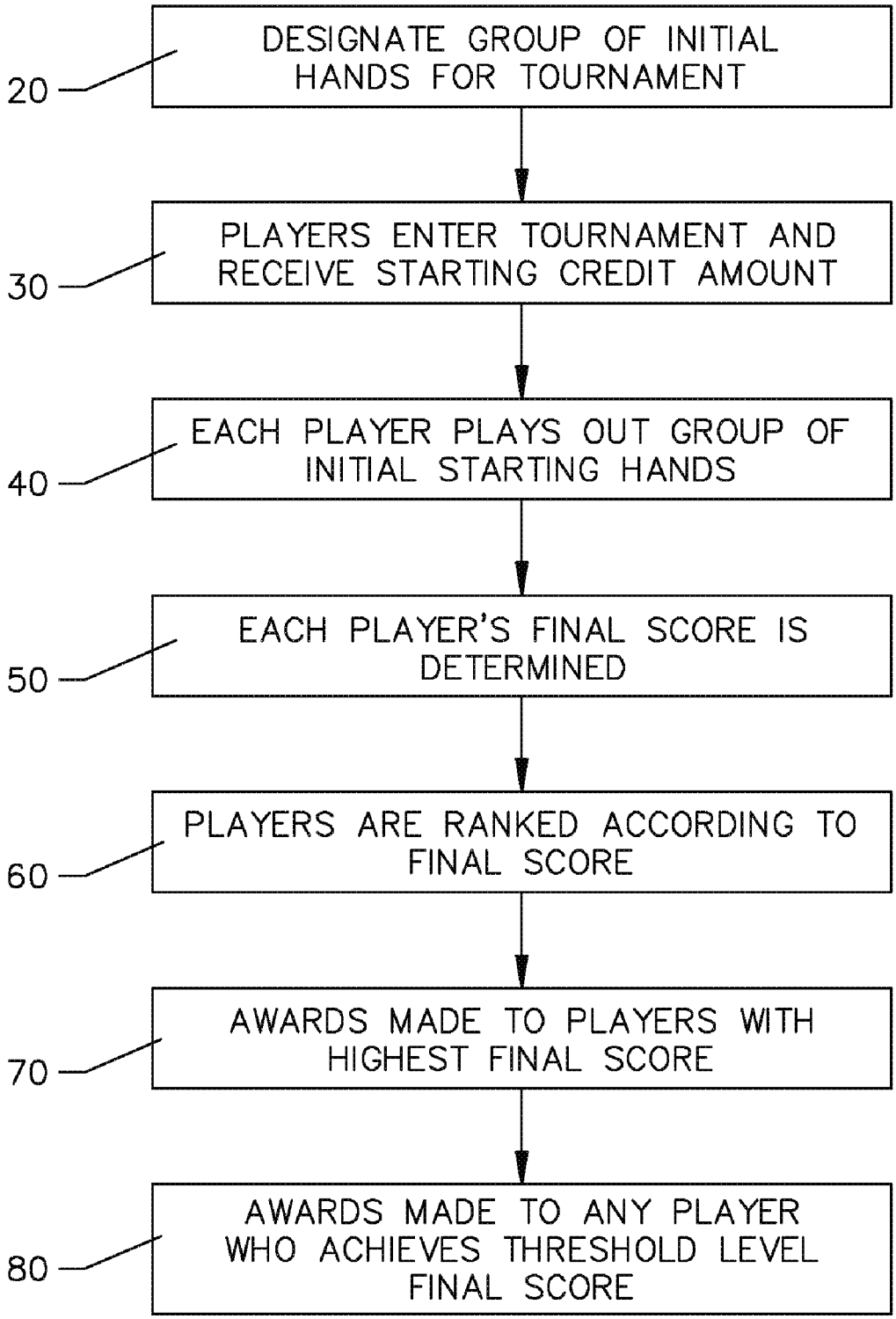
FIG. 1 shows a flow chart of Version 1 of the method of the present disclosure.

Version 1 of the present disclosure involves having multiple players participate in a single level video poker tournament. FIG. 1 shows in flow chart format the steps of the method of the tournament play.

Prior to the start of the tournament, a group of initial hands are designated 20 as the starting hands to be used by all players in the tournament. For example, the video poker game format for the tournament could be Double Double Bonus Poker and each video poker machine would be configured to provide a Double Double Bonus Poker pay table. Alternatively, any suitable video poker game format and any suitable pay table could be used as long as each player in the tournament is playing the same game format and using the same pay table.

Each player who wishes to play in the tournament enters the tournament 30 by paying an entry fee or by using a complimentary or discounted entry provided by the gaming establishment. The gaming establishment could award the player a free or partially paid entry into the tournament as a marketing tool for the gaming establishment or as a reward to the player for previous gaming activity.

Upon activating his entry into the tournament, each player starts with a fixed number of credits, say 200 credits, on his video poker machine.

The tournament comprises the group of initial hands which is a fixed number of hands of play of video poker. Each player plays out his starting hands 40 until the player has either exhausted his credits or completed all of the starting hands. The play is in the conventional manner of play of video poker in which the player discards unwanted starting cards from each starting hands and replacement cards are displayed for the discarded cards which results in a final poker hand.

Predetermined final poker hands are considered winning card arrangements and the player receives a score for each hand based on the poker hand ranking of the final hand and the amount of credits wagered by the player. The possible poker hand rankings are shown in the pay table associated with the poker game format being used.

The tournament method of the present disclosure may allow the player to vary the number of credits that may be wagered on each starting hand. For example if a group of ten starting hands are used, the player may bet five to fifty credits on each of starting hands one through five and may be bet five to all of his remaining credits on each of starting hands six through ten. At any point that the player has no credits remaining, the player may not play any remaining starting hands and he receives a final score of zero.

The player plays his video poker hands for each of starting hands one through ten and the player accrues credits for each final winning hand achieved in any round. At the end of group of starting hands, say ten hands, the player will have achieved a final score 50 represented by the number of credits that the player has remaining on the credit meter.

The player's final score is recorded and posted for other players to beat. As the tournament progresses, each player's final score is determined and the players are ranked according to their final scores 60.

At the conclusion of the tournament, awards are made to the players with the highest scores 70, with the top final score typically receiving the best award and the other places receiving lesser awards.

An award pool comprising money or other valuable prizes could be established by the gaming establishment to award to the tournament winners. The player with the highest final score could receive the entire award pool or the awards could be made for finishing in the group with the highest final scores. For example, in a tournament having 1000 participants, awards could be made to the players with the highest fifty scores. In a preferred embodiment of the present disclosure, the prizes to be awarded are posted at the start of the tournament so that each participant would know how many places are being paid and how high a final score would be needed to receive an award regardless of the final placing of the player in the tournament. Alternatively, a conversion table could be posted so that each player knows what award he would receive for achieving various levels of his final score.

The player may also receive a cash bonus or other prize, such as a free entry into a subsequent tournament, for achieving a final score of at least some threshold level, say 500 credits 80.

Each player in the tournament plays the same ten starting hands. The ten starting hands can be randomly selected in advance by the main computer to which all of the video poker machines are connected. Or a preselected group of ten starting hands may be programmed and stored in the main computer for display to each player participating in the tournament.

The tournament could run until a fixed length of time has expired or until a fixed number of players have participated or until a player achieves a predetermined final score. This would allow a particular player to participate more than once in the tournament.

Version 2

Figure 2:
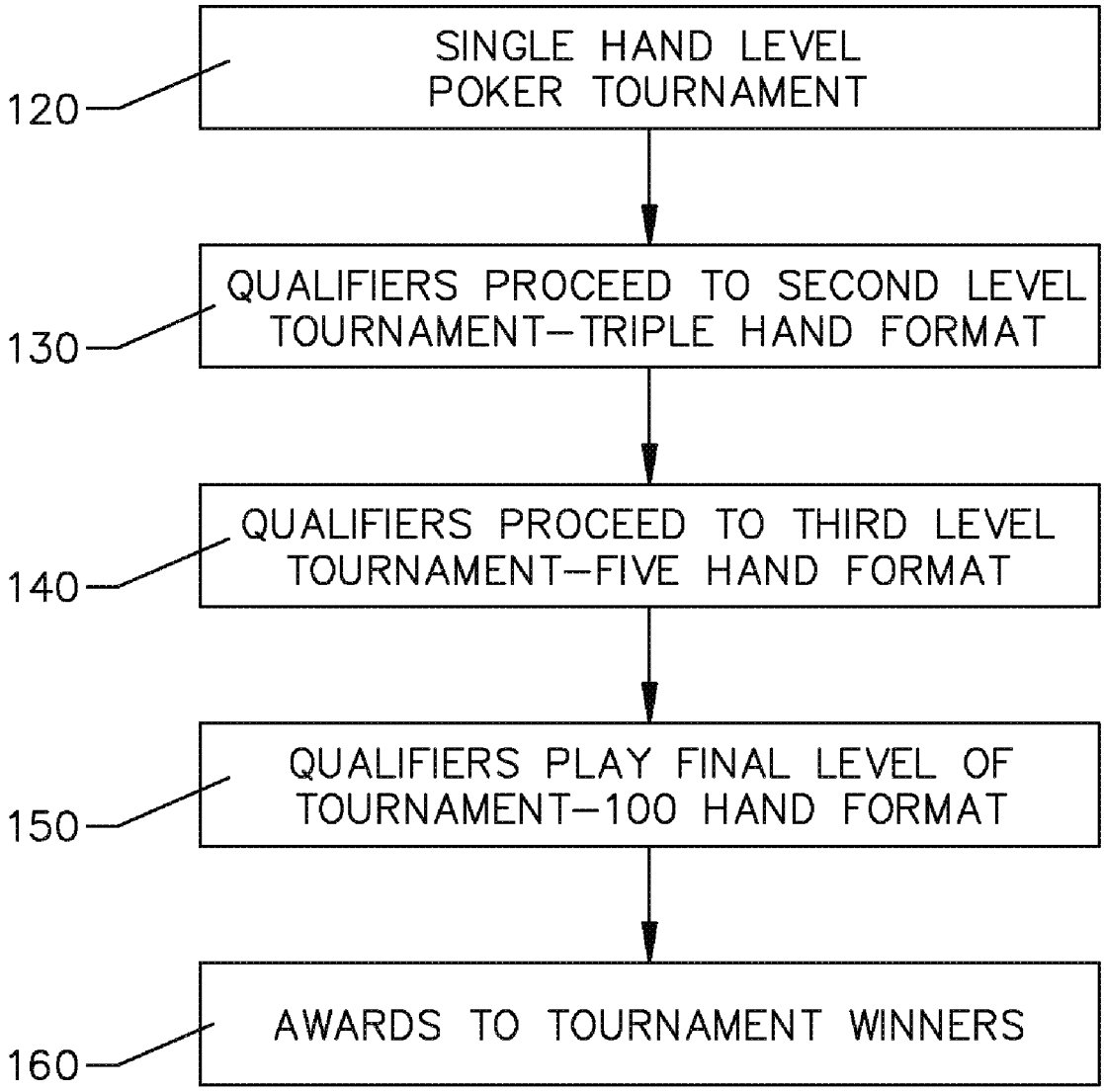
FIG. 2 shows a flow chart for Version 2 of the method of the present disclosure.

Version 2 of the present disclosure involves a tournament format in which the player must proceed through various levels of tournament play to achieve the highest payout and FIG. 2 shows the format for this tournament version. For example, in the first level of the tournament, the player plays ten initial starting hands of single hand video poker 120. The players with the highest scores, say the top 500 players, advance to the second tournament level 130.

In the second tournament level, the players play ten initial starting hands of triple hand video poker with the another cut being made of the players with the highest scores advancing to the third level of the tournament 140.

The tournament could proceed through consecutive levels of five hand poker, ten hand poker, fifty hand poker to the final round of one hundred hand poker 150. Whatever credits the player has achieved at the end of each level would carryover to the next round.

As discussed above, an award pool comprising money or other valuable prizes could be established by the gaming establishment to award to the tournament winners 160. The player with the highest final score could receive the entire award pool or the awards could be made for finishing in the group with the highest final scores. For example, in a multi-level tournament having 5000 participants, awards could be made to the players with the highest fifty scores at the end of the final level. The player with the highest score at the end of each intermediate level could also receive an award.

In a preferred embodiment of the present disclosure, the prizes to be awarded are posted at the start of the tournament so that each participant would know how many places are being paid and how high a final score would be needed to receive an award regardless of the final placing of the player in the tournament. Alternatively, a conversion table could be posted so that each player knows what award he would receive for achieving various levels of his final score.

The variables in the multi-level tournament format of the present disclosure would be the amount of the entry fee to be paid by each player, the number of levels of the tournament, the number of rounds of video poker to be played at each level of the tournament and the types of poker games to be played at each level. The value and amounts of the prizes awarded would be selected to provide an appropriate profit to the gaming establishment operating the tournament.

Version 3

Figure 3:
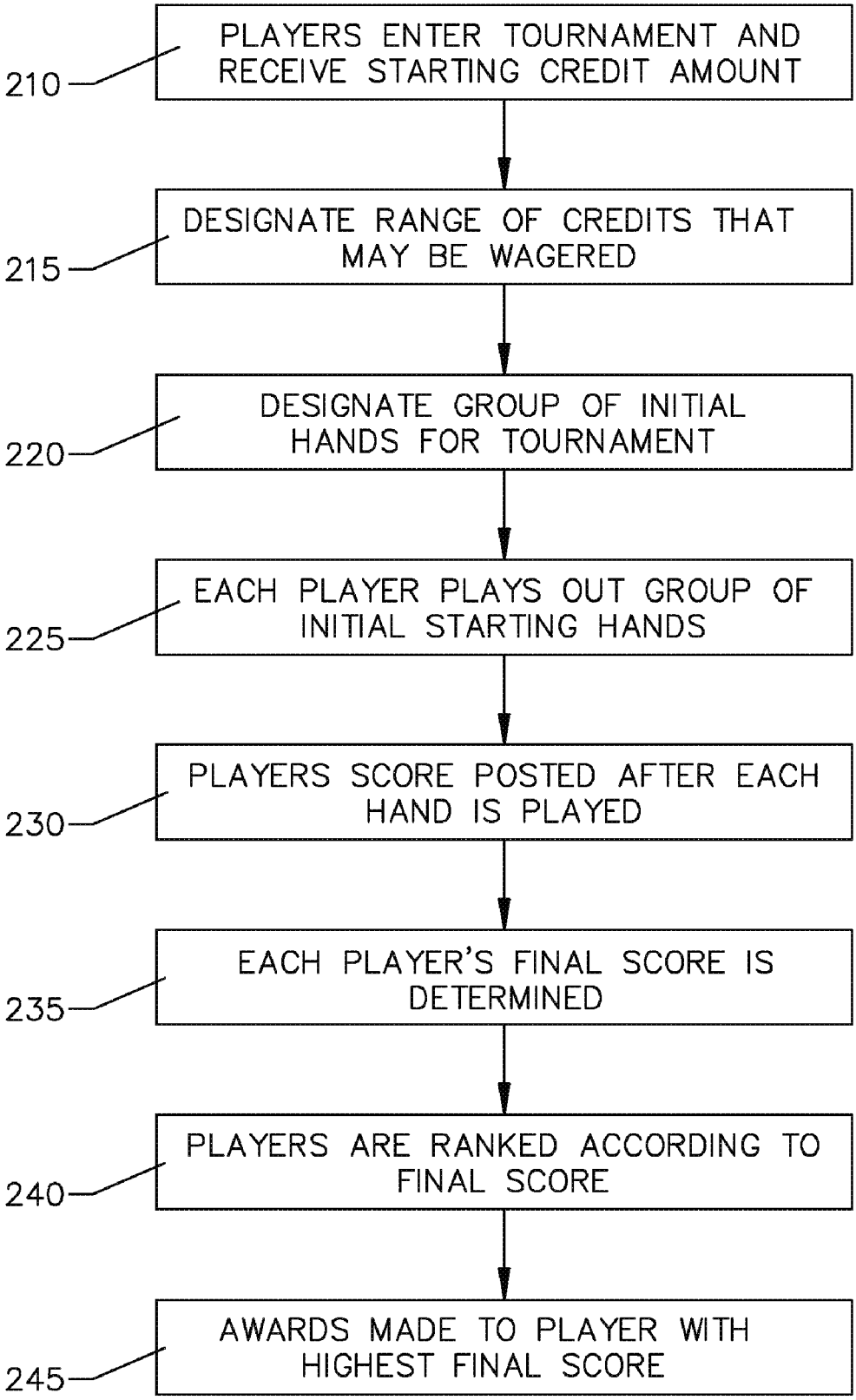
FIG. 3 shows a flow chart for Version 3 of the method of the present disclosure.

Version 3 of the present disclosure involves another method of playing a video poker tournament. A preferred embodiment utilizes a standard deck of playing cards, although decks of cards using one or more jokers or wild cards may also be used. A flow chart for Version 3 is shown in FIG. 3.

The tournament would involve a plurality of players and should have at least two players. The players enter the tournament 210 by paying an entry fee, or using a free entry received from the tournament operators or other suitable manner of determining player tournament eligibility. Each entered player receives a predetermined number of credits 210 that are used to wager on the poker hands being played in the tournament. For example, each player may be provided with five hundred credits at the start of the tournament.

As part of the tournament, a plurality of poker hands will be played. Each player wagers a number of credits on each poker hand. A range of credits is designated 215 that may be wagered in the play of the tournament—for example, a player may wager from one to one hundred credits or even all of his remaining credits on each hand he is playing. A player may wager the same number of credits on each hand or the player may vary the number of credits wagered as each hand to play is presented to the player. This decision on how many credits to wager on each hand is part of the strategy of the tournament. Typically, once a player has lost all of his credits, he is out of the tournament and receives a final score of zero.

Also, a predetermined number of hands are designated that will be used in the play of the tournament. The maximum number of hands to be played by each player is the same so the length of play of the tournament is determined by the number of hands that are designated. A tournament that will take a short time to play could have a small number of hands, say ten, while a tournament that will take a longer time to play will have a larger number of hands, say one hundred or more.

A group of initial hands selected from the deck of playing cards are designated 220 as the starting hands to be used in play of the tournament. In one embodiment of the method, the group of initial hands are randomly dealt and recorded in a suitable manner so that the group of initial hands can be reproduced for each player. In one manner of play, each player would play the same starting hands in the same order. In another manner of play, the order of play of the hands would be varied from player to player as long as each player eventually would have the ability to play all of the initial hands. Any suitable number of initial hands could be used, such as ten, twenty-five, fifty, one hundred or even two hundred initial hands.

To give one of many examples that could be used, a tournament is set up so that each player would play one hundred starting hands. Each of the one hundred starting hands would be randomly selected. The order of presenting these one hundred starting hands to each player would be permuted so that no two player would receive the one hundred starting hands in the same order. It is also possible to permute the suits and some of the ranks of each starting hand so that any potential collusion among players would be minimized, if not eliminated.

Instead of randomly selecting the group of initial starting hands, a preselected group of initial starting hands could also be used. When using a preselected group of initial starting hands, all of the initial starting hands could hands that are easy to play, hands that are difficult to play or a mixture of easy hands and difficult hands.

As an alternative to having each player use the same starting hands, each original initial hand that has been randomly dealt would be analyzed to determine the Expected Value of that original hand. This can be done in any suitable manner such as the method disclosed in U.S. Pat. No. 6,343,989 (Wood et al.), the disclosure of which is incorporated herein in its entirety. Once the Expected Value of an original hand has been determined, one or more initial hands are determined that have the similar expected value as the Expected Value of the original hand. This is done for each original initial hand. U.S. Pat. No. 6,878,060 (Moody), the disclosure of which is incorporated herein in its entirety, describes how a second hand having a similar Expected Value to the Expected Value of an original hand can be determined.

Thus, on a hand-by-hand basis, the initial hands for each player are not identical but have the same Expected Value as the initial hands for each other player. Alternatively, the combined Expected Value for all of the hands in the group of initial starting hands would be calculated and the other groups of initial starting hands could be selected so that each group of initial starting hands would have the same combined Expected Value.

It is also possible to calculate a "Volatility" for each starting hand or a combined "Volatility" for the group of starting hands. Therefore, each group of starting hands would not have to be identical, but could be determined by choosing those that have the same "Volatility".

Once the group of initial starting hands has been selected, tournament play begins. Each player in the tournament plays out 225, according to the conventional manner of play of video poker, each starting hand from the group of starting hands. Each player selects how many credits he wishes to wager on a starting hand, the starting hand is displayed to the player, the player selects which cards he wishes to hold from the cards of the starting hand and replacement cards are displayed for the cards that were not held. This results in a final hand. Each final hand receives a score based on the poker hand ranking of the final hand.

The replacement cards that are dealt for the discarded cards are randomly selected so that each player would randomly receive different replacement cards than the replacement cards dealt to the other players. Thus each player would generally receive different final hands than the final hands dealt to the other players.

One manner of determining the score of each final hand is to use a typical video poker pay table which awards the player credits based on the poker hand ranking of the final hand and the number of credits wagered on that hand. In this manner, the each player's score for a final hand is the number of credits that are won on that hand.

For example, a player starts the tournament with five hundred credits. On the first hand played, the player wagers five credits and has final hand of Three-of-a-Kind. The player would win fifteen credits for this poker hand and the player's running score after one hand would then be five hundred ten credits. This manner of play continues through each hand of the tournament and the player ends up with a final amount of credits after all hands are played. The final amount of credits is the player's final score 235. A pay table can be displayed to the players showing the score that may be achieved for each final hand based on the number of credits wagered.

Preferably, the score for each player for each final hand is posted 230 so that the other players can see how that player is progressing as the tournament proceeds.

As each starting hand is to be played, each player is allowed to vary the number of credits wagered on each starting hand. This is part of the strategy of tournament play so that a player can attempt to increase a low score or preserve a high score as the tournament proceeds.

As each player completes his tournament play by playing all of the tournament hands (unless the player has exhausted his credits before completing all of the tournament hands which would result in the player receiving a final score of zero), the player is ranked according to his final score 240.

The player with the highest final score after all players have completed the tournament if the winner and receives an award 245. Additionally, other players with high scores may also receive awards. These additional awards may be based on the player's position in the overall score ranking, e.g. the top twenty players receive an award, or may be based on a player achieving a minimum final score, e.g. anyone having a final score of at least one thousand receives an award.

Any suitable tournament format may be used. A tournament may run for a certain length of time, such as five hours or one day, or a tournament may run until a certain number of players have entered and competed, such as four hundred players. In either case, the tournament format may even allow the same player to enter more than once in the same tournament.

Version 4

Figure 4:
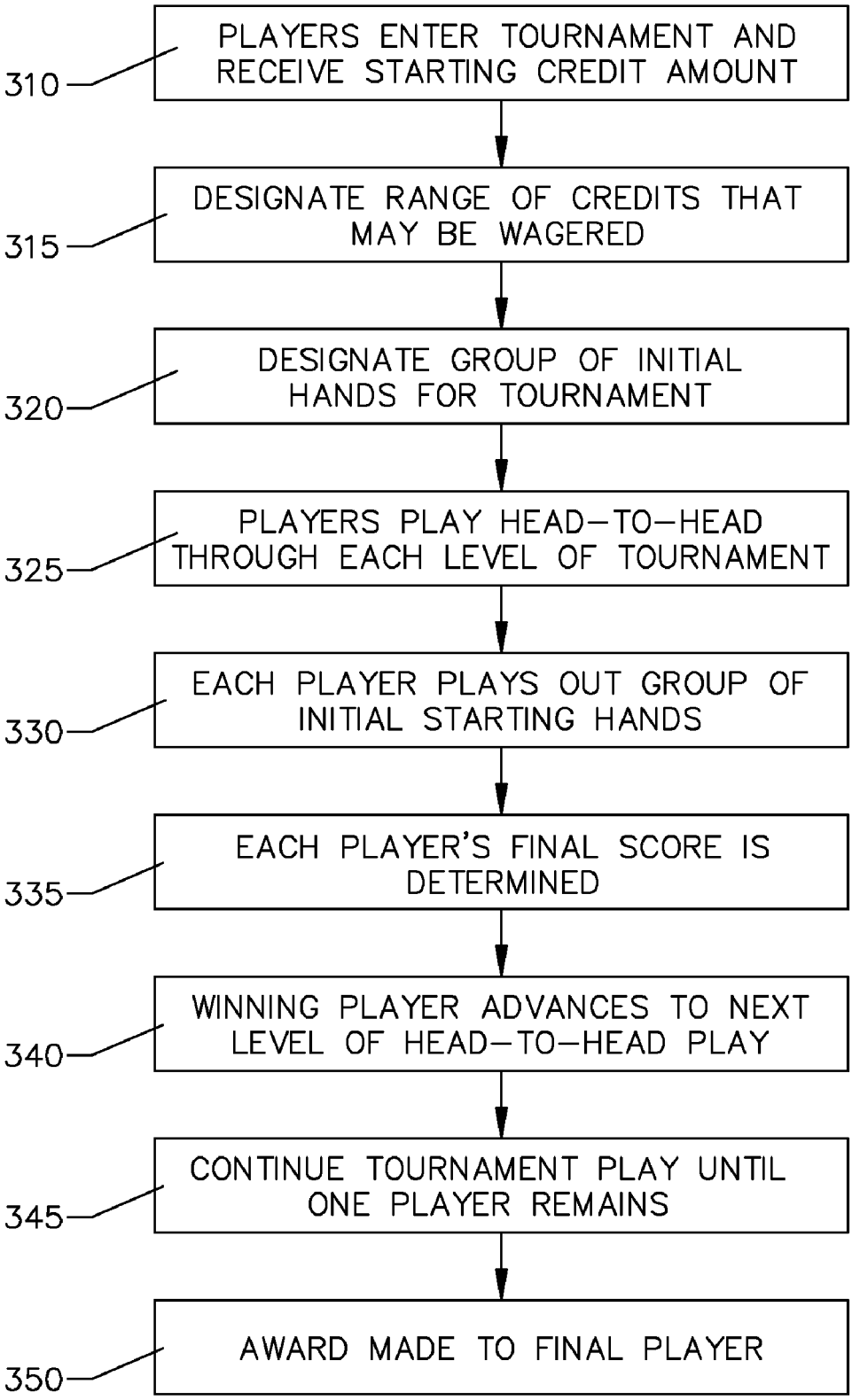
FIG. 4 shows a flow chart for Version 4 of the method of the present disclosure.

Version 4 of the present disclosure involves another method of playing a video poker tournament. A preferred embodiment utilizes a standard deck of playing cards, although decks of cards using one or more jokers or wild cards may also be used. A flow chart for Version 4 is shown in FIG. 4.

This tournament method involves multiple players playing rounds or levels of the tournament in a head-to-head format until a single player is remaining who is designated as the winner. The tournament would preferably have at least four players at the start, although a larger number of players can be accommodated.

The players enter the tournament 310 by paying an entry fee, or using a free entry received from the tournament operators or other suitable manner of determining player tournament eligibility. Each entered player receives a predetermined number of credits 310 that are used to wager on the poker hands being played in the tournament. For example, each player may be provided with five hundred credits at the start of the tournament.

As part of the tournament, a plurality of poker hands will be played. Each player wagers a number of credits on each poker hand. A range of credits is designated 315 that may be wagered in the play of the tournament—for example, a player may wager from one to one hundred credits or even all of his remaining credits on each hand he is playing. A player may wager the same number of credits on each hand or the player may vary the number of credits wagered as each hand to play is presented to the player. This decision on how many credits to wager on each hand is part of the strategy of the tournament. Typically, once a player has lost all of his credits, he is out of the tournament and receives a final score of zero.

Also, a predetermined number of hands are designated that will be used in the play of each level of the tournament. The maximum number of hands to be played by each player in each level is the preferably the same.

A group of initial hands selected from the deck of playing cards are designated 320 as the starting hands to be used in play of the tournament. Any suitable manner of selecting the starting hands may be used such as the manner described in connection with Version 3, above.

Once the group of initial starting hands has been selected, that level of the tournament play begins. The players in the tournament are paired off for head-to-head play 325. Each player in the tournament plays out 330, according to the conventional manner of play of video poker, each starting hand from the group of starting hands. Each player selects how many credits he wishes to wager on a starting hand, the starting hand is displayed to the player, the player selects which cards he wishes to hold from the cards of the starting hand and replacement cards are displayed for the cards that were not held. This results in a final hand. Each final hand receives a score based on the poker hand ranking of the final hand.

One manner of determining the score of each final hand is to use a typical video poker pay table which awards the player credits based on the poker hand ranking of the final hand and the number of credits wagered on that hand. In this manner, the each player's score for a final hand is the number of credits that are won on that hand.

For example, a player starts that level of the tournament with five hundred credits. On the first hand played, the player wagers five credits and has final hand of Three-of-a-Kind. The player would win fifteen credits for this poker hand and the player's running score after one hand would then be five hundred ten credits. This manner of play continues through each hand of that level of the tournament and the player ends up with a final amount of credits after all hands are played. The final amount of credits is the player's final score 335 for that level. A pay table can be displayed to the players showing the score that may be achieved for each final hand based on the number of credits wagered.

Preferably, the running score for each player for each final hand is posted 230 so that his opponent, or even the other players, can see how that player is progressing as the tournament proceeds.

As each starting hand is to be played, each player is allowed to vary the number of credits wagered on each starting hand. This is part of the strategy of tournament play so that a player can attempt to increase a low score or preserve a high score as the tournament proceeds.

As each player completes his level of tournament play by playing all of the tournament hands (unless the player has exhausted his credits before completing all of the tournament hands which would result in the player receiving a final score of zero), the player's final score is determined 335 and is compared with his opponent's final score and the high score is the winner and advances to the next level of the tournament 340.

All of the winners from the first level of the tournament are repaired for head-to-head play for the next level of the tournament. Each player is given the same number of credits for the next level of play, or alternatively, the credits each player has remaining from the previous level of the tournament may carry over to the next level. Another level of head-to-head tournament play is conducted in the same manner as the previous level of play with again each head-to-head winner carrying over to the next level.

These levels of tournament play continue until one player is left 345. The last remaining player is the winner and receives an award 350.

What is claimed is:

1. A method of playing a video poker tournament utilizing a deck of playing cards comprising:

a) at least two players entering the tournament; each player receiving a predetermined number of credits;

b) designating a range of credits from which each player selects the credits to be wagered in the play of the tournament;

c) designating a predetermined number of hands that will be used in the play of the tournament;

d) designating a group of initial hands selected from the deck of playing cards as the starting hands to be used in play of the tournament;

e) each player in the tournament playing out, according to the conventional manner of play of video poker, each starting hand from the group of starting hands and allowing each player to vary the number of credits wagered on each starting hand;

f) as each starting hand is played out to a final hand, awarding a score for each final hand based on the poker hand ranking of each final hand;

g) accruing a running score for each player based on his scores for each final hand and noting a final score for each player after all of the starting hands have been played;

h) ranking each player according the final score of the player; and i) making an award to the player with the highest final score.

2. The method of claim 1 in which the initial hands for each player are identical.

3. The method of claim 1 in which the initial hands for each player are not identical but have the same Expected Value as the initial hands for each other player.

4. The method of claim 1 in which the running score for each player is displayed during the play of the tournament.

5. The method of claim 1 including making an award to each player who achieves a high final score.

6. The method of claim 1 including making an award to each player who achieves at least a final score of a certain level.

7. The method of claim 1 including providing that a player receives a final score of zero if the player has no credits remaining before the player has played out all of the initial hands.

8. The method of claim 1 in which the tournament runs for a predetermined length of time and any player may enter the tournament more than once.

9. The method of claim 1 in which the score for each final hand is determined by both the poker hand ranking of the final hand and the number of credits wagered on the play of the starting hand that resulted in the final hand.

10. The method of claim 9 in which a pay table is displayed to the player showing the score that may be achieved for each final hand based on the number of credits wagered.

11. A method of playing a video poker tournament utilizing a deck of playing cards and having multiple levels of competition comprising:

a) at least four players entering the tournament; each player receiving a predetermined number of credits;

b) designating a range of credits from which each player selects the credits to be wagered in the play of the tournament;

c) designating a predetermined number of hands that will be used in the play of the tournament;

d) designating a group of initial hands selected from the deck of playing cards as the starting hands to be used in play of the tournament;

e) separating the players into groups of two players each for head-to-head play at each level of the tournament;

f) each player in the tournament playing out, according to the conventional manner of play of video poker, each starting hand from the group of starting hands and allowing each player to vary the number of credits wagered on each starting hand;

g) as each starting hand is played out to a final hand, awarding a score for each final hand based on the poker hand ranking of each final hand;

h) accruing a running score for each player based on his scores for each final hand and noting a final score for each player after all of the starting hands have been played;

i) determining according to the final score of the player which player is the winner of the head-to-head play and advancing the winning player to the next level of the tournament;

j) continuing head-to-head play at a next level of tournament until only one player remains; and k) making an award to the one player who remains.

12. The method of claim 11 in which the initial hands for each player are identical.

13. The method of claim 11 in which the initial hands for each player are not identical but have the same Expected Value as the initial hands for each other player.

14. The method of claim 11 in which the running score for each player is displayed during the play of the tournament.

15. The method of claim 11 including providing that a player receives a final score of zero if the player has no credits remaining before the player has played out all of the initial hands.

16. The method of claim 11 in which the score for each final hand is determined by both the poker hand ranking of the final hand and the number of credits wagered on the play of the starting hand that resulted in the final hand.

17. The method of claim 16 in which a pay table is displayed to the player showing the score that may be achieved for each final hand based on the number of credits wagered.

* * * * *